US005947881A

United States Patent [19]

Fournier

[11] Patent Number: 5,947,881

[45] Date of Patent: Sep. 7, 1999

[54] SLITTER FOR USE WITH ROLLED MATERIAL

[76] Inventor: Emile Fournier, 179 Edgeland Road, N.W. Calgary, Alberta, Canada, T3A 2Y3

[21] Appl. No.: 08/995,893

[22] Filed: Dec. 22, 1997

Related U.S. Application Data

[63] Continuation-in-part of application No. 08/757,499, Nov. 27, 1996

[60] Provisional application No. 60/007,814, Nov. 30, 1995.

[51] Int. Cl.[6] ..... B25F 05/02

[52] U.S. Cl. ..... 492/15; 83/698.51; 83/699.51

[58] Field of Search ..... 83/18, 175, 374, 83/459, 698.51, 699.51; 492/15, 16, 47; 74/640

[56] References Cited

U.S. PATENT DOCUMENTS

| | | | |
|---|---|---|---|
| 1,627,747 | 5/1927 | Rasmussen | 492/15 X |
| 3,565,001 | 2/1971 | Zimmer | 492/15 X |
| 3,863,537 | 2/1975 | Huelsman | 83/698.51 X |
| 4,226,151 | 10/1980 | Littley et al. | 83/699.51 X |
| 4,649,631 | 3/1987 | Orth | 492/17 X |
| 4,691,606 | 9/1987 | Johnson et al. | 83/175 |
| 4,928,505 | 5/1990 | Parks et al. | 492/15 X |
| 5,017,184 | 5/1991 | Takahori et al. | 83/699.51 X |
| 5,081,488 | 1/1992 | Suzuki | 492/15 X |
| 5,392,676 | 2/1995 | Drury | 83/455 |

*Primary Examiner*—Charles A Marmor
*Assistant Examiner*—Peter T. Kwon
*Attorney, Agent, or Firm*—Sheldon H. Parker

[57] ABSTRACT

A graduated gear assembly provides for controlled movement between a stationary support surface and exterior contact surface. The assembly contains two discs are supported by a roller shaft affixed to the support surface. The first disc has a contact surface and an opposing receiving surface containing bearing retaining area. The first side of the second disc contains a recessed bearing receiving area to receive the female portion of the bearing. The opposing second side has a plurality of recessed arcs each containing a receiving area and a sphere receiving ridge. A plurality of spheres are immovably affixed to the support surface and a handle is rigidly affixed, and moves with, the discs, which rotate as a single unit. The unit is rotated to a first position wherein the spheres are within the recessed arcs and a second position wherein the spheres are within the sphere receiving areas. Rotation of the disc unit to the second position moves the unit in a direction distal to said support surface and rotation to the first position moves the unit proximal to the support surface. A locking mechanism is secured to the support frame used to stabilize the shaft's unsecured end. The locking mechanism has a support bar is hingeably affixed to the support frame. A handle is adjacent the second end of the support bar. A plug is dimensioned to fit within the open end of the roller shaft and is used to lock the bar in place.

9 Claims, 6 Drawing Sheets

SLITTER FOR USE WITH ROLLED MATERIAL

RELATE BACK

This is a continuation-in-part of copending application Ser. No. 08/757,499 filed on Nov. 27, 1996, and U.S. Provisional Ser. No. 60/007,814 filed on Nov. 30, 1995.

BACKGROUND OF THE INVENTION

1. Field of the Invention

The instant invention relates to a novel gear system for use with slitting machine for use in cutting rolled material, such as magnetic, vinyl, reflective, pre-mask and banner material. Further a locking end allows the material carrying support to be open at one end to rapidly change the rolls of material.

2. Brief Description of the Prior Art

Rolled materials are used in many areas for various end uses. Because the final products can range from display banners to car detailing strips, a machine used for cutting the material must be highly adjustable and accurate. The material cut by the machines is highly varied as to weight and resistance to the cutting blade, as well as the width of the cut. Prior art machines have been large lathe-like devices which are heavy and extremely expensive.

The disclosed machine overcomes the problems associated with the prior art by allowing for accurate cuts to be obtained in an easily portable machine.

SUMMARY OF THE INVENTION

A graduated gear assembly is disclosed which provides for controlled movement between a stationary support surface and exterior contact surface. The assembly contains two discs which are supported by a roller shaft which rotates freely within the discs. The roller shaft is affixed to, and is normal to, the support surface. Preferably the discs are manufactured from, or alternatively coated with, a low friction material. The first disc has an exterior contact surface and an opposing bearing receiving surface containing bearing retaining means. The first side of the second disc contains a recessed bearing receiving area which is, preferably, provided with a bearing ledge which encompasses the center support receiving area to receive the female portion of the bearing. The opposing second side has a plurality of recessed arcs, each of the arcs containing a recessed sphere receiving area. To maintain the sphere within the receiving area, a sphere receiving ridge is placed proximate each area. A bearing having a female portion and a male portion, is placed within the discs. The male portion is dimensioned to interact with the bearing retaining means and said female portion is dimensioned to be received within the recessed bearing receiving area. A plurality of spheres are immovably affixed to the support surface in a position which enables them to be received within the recessed arcs. A handle is rigidly affixed to the second disc and moves in conjunction with the disc.

The female portion of the bearing interacts with the male portion of the bearing to rotate the discs as a single disc unit. The disc unit is rotated to a first position wherein the spheres are within the recessed arcs and a second position wherein the spheres are within the sphere receiving areas. Rotation of the disc unit to the second position moves the unit in a direction distal to said support surface and rotation to the first position moves the unit proximal to the support surface. The degree of movement between the first and second positions is determined by the ratio between the spheres and the recessed arcs and sphere receiving areas.

A hollow roller shaft for retaining the roll material is rigidly connected to the support frame at one end and open at a second, unsecured end. The swing bar locking mechanism is secured to the support frame used to stabilize the unsecured end. The locking mechanism has a support bar with a hinge to movably affixed a first end of the bar to the support frame. A handle is adjacent the second end of the support bar. A plug, at the second end, is dimensioned to fit within the open end of the roller shaft and is used to lock the bar in place. The unsecured end of can have a receiving area which has a flexible interior coating which is dimensioned to maintain the plug in a friction fit.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
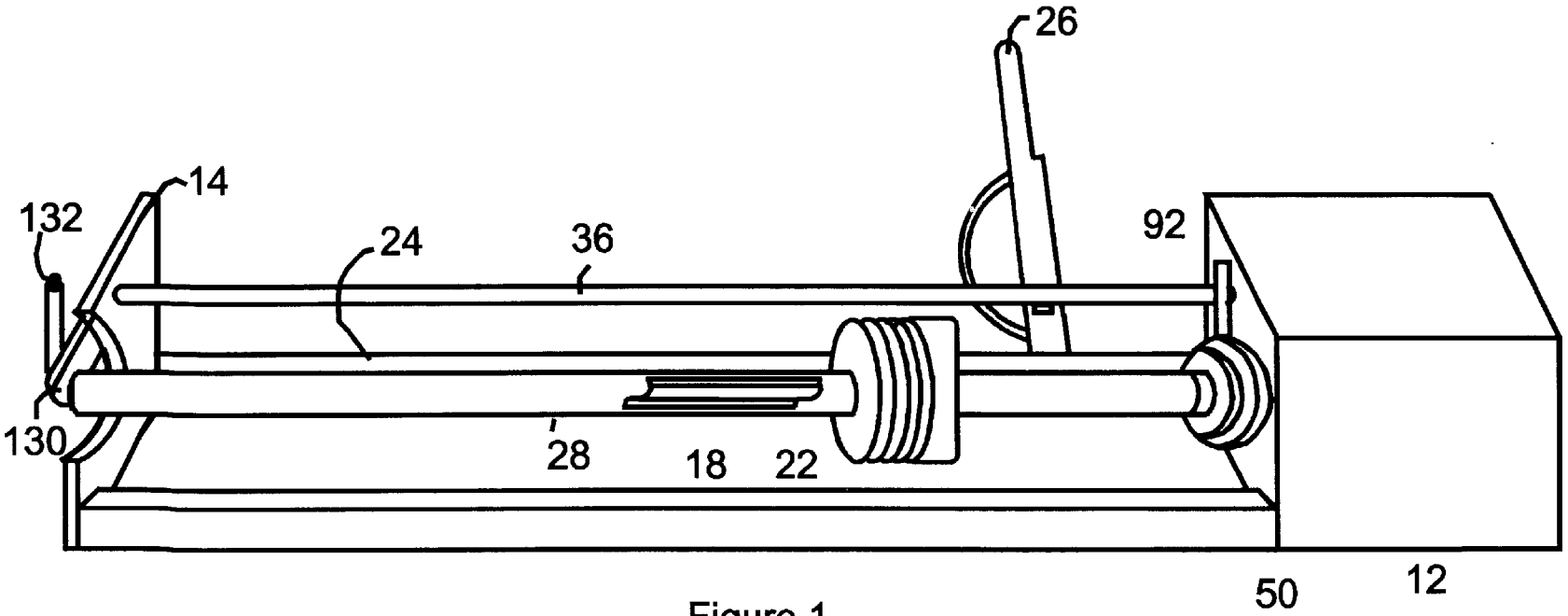
FIG. 1 is a perspective view of the assembled machine.

The overall view of the expansion ring slitter 10 is illustrated in FIG. 1. The slitter 10 is used to accurately cut rolled materials such as packaging and adhesive tapes, pre-mask, or vinyl. The slitter is structurally supported by a motor case 12 and a contoured wall 14, which are connected by the base frame 16 and upper support bar 36. A roller shaft 18 extends, at right angles, from the motor case 12 to the contoured wall 14. The roller shaft 18 is provided with an expansion ring 20 adjacent the locking arc drive assembly 50. Once the expansion ring 20 is in position adjacent the drive assembly 50 a rigid cover 28 is slid over the roller shaft 18 to abut the expansion ring 20. The rigid cover 28 must remain stationary on the roller shaft 18 and is maintained in position through use of a T-shaped nut or other means known in the art. The rolled material is slid onto the roller shaft 18 and abutted against the locking arc drive assembly 50 to align the rolled material over the expansion ring 20 and prevent shifting. The graduated gear 52 is connected to, and controls, the locking arc assembly 50, as disclosed further herein. The rolled material 22 is placed over the expansion ring 20 when the graduated gear 52 is in the unlocked position. To secure the rolled material, the graduated gear 52 is placed in the locked position, causing the expansion ring 20 to lock the rolled material 22 into place. The blade support bar 24 extends from the motor case 12 to the contoured wall 14 and supports the cutting blade lever assembly 26. Once the blade lever assembly 26 is placed in the desired position above the rolled material the activation bar is squeezed, causing the locking arc drive assembly 50 to rotate, thereby rotating the expansion ring 20 and rigid cover 28. As disclosed in U.S. Ser. No. 08/757,499, once the activation bar is squeezed, the handle is maintained in a fixed position relative to its position along the bar, but is free to rotate about the bar, to maintain accurate cutting. Once the roll has been cut, the lever assembly 26 is released and the rolled material 22 is removed from the roller shaft 18.

The '449 application utilized a dual support shaft to activate the expansion ring and lock the rolled material in place. This system has been simplified through use of the disclosed locking arc drive assembly 50, illustrated in more detail in FIGS. 2–8.

Figure 2:
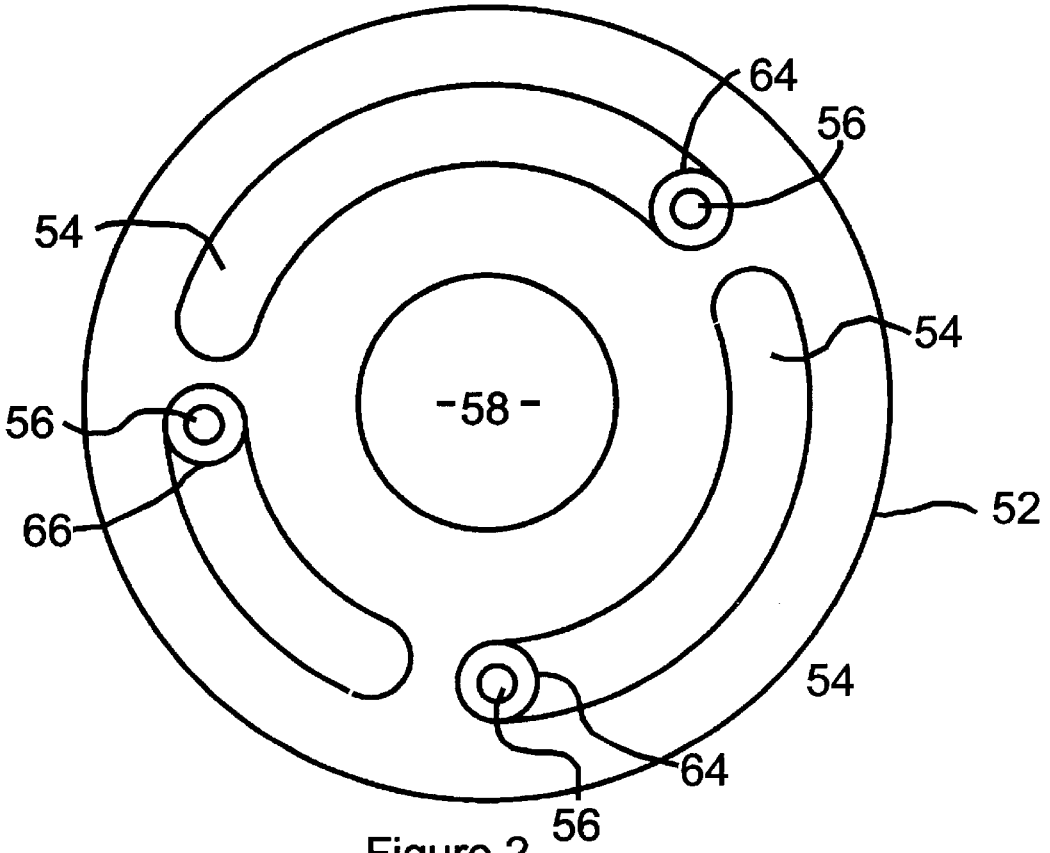
FIG. 2 is a top view of the locking arc of the instant invention.

The front side of the graduated gear 52 is illustrated in FIG. 2 showing the grooved rotating arcs 54 and sphere receiving areas 56. Each of the grooved rotating arcs 54 is provided with a sphere receiving area 56 which serves as a recessed resting area for the spheres 80, illustrated in FIG. 4. The depth of the grooved rotating arcs 54 must be less than one half of the diameter of the spheres 80 to provide the desired horizontal movement. The circumference of the arcs 54 must also be slightly greater than that of the spheres 80 to allow the spheres 80 to slide freely along the arc 54. If, however, the diameter of the arcs 54 is substantially larger than the spheres 80, the graduated gear 52 will wobble and rotation of the gear 52 will not be as smooth as necessary. The sphere receiving areas 56 are recessed approximately one third the diameter of the spheres 80 and are rimmed at receiving edge 66. This allows the spheres to lock into the receiving areas 56 to prevent undesired rotation of the gear 52. The degree of horizontal movement is regulated by the ratio between diameter of the spheres and the receiving areas 56. Too great a ratio and the expansion ring 20 is arced too far; too little a ratio and the expansion ring 20 has too little an arc and will not hold the rolled material securely. The ratios will become apparent to those skilled in the art.

Figure 3:
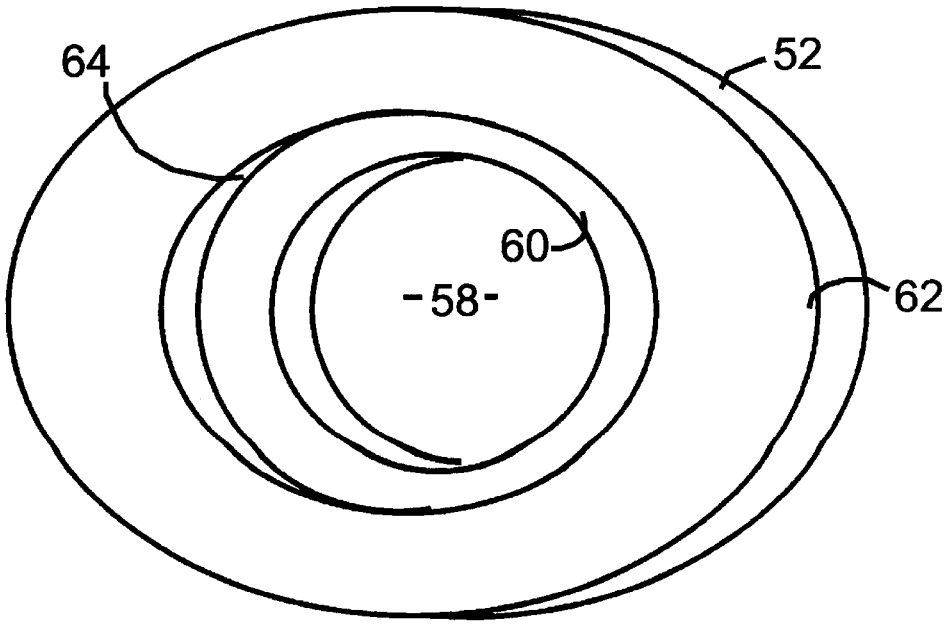
FIG. 3 is a perspective bottom view of the locking arc of FIG. 2.
Figure 4:
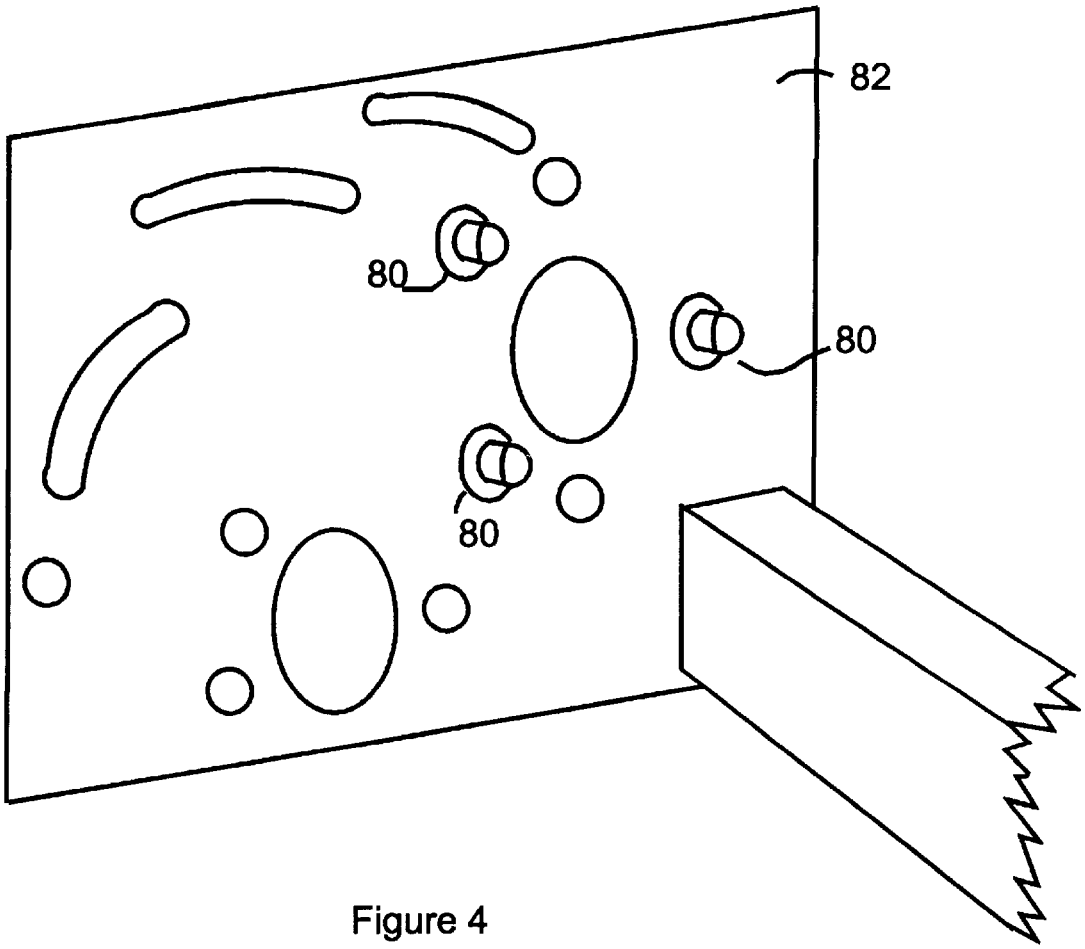
FIG. 4 is a perspective view of the retaining wall of the motor case.

The spheres 80 are immovably affixed to the retaining wall 82 of the motor case 12 and, as stated, are dimensioned to be positioned in, and interact with, the grooved rotating arcs 54 and the sphere receiving areas 56. The graduated gear 52 is preferably manufactured from a slick, high impact plastic, although other materials can be used. The back surface 62 of the graduated gear 52, as shown in FIG. 3, is recessed to receive the cylindrical half of a Timken, or equivalent, bearing 64. The cylindrical bearing 64 sits on the bearing rim 60 and is affixed to the sides of the recess to prevent the cylindrical bearing 64 from rotating within the gear 52. The shaft receiving area 58 is dimensioned to be approximate the shaft receiving area 84 of the retaining wall 82.

Figure 5:
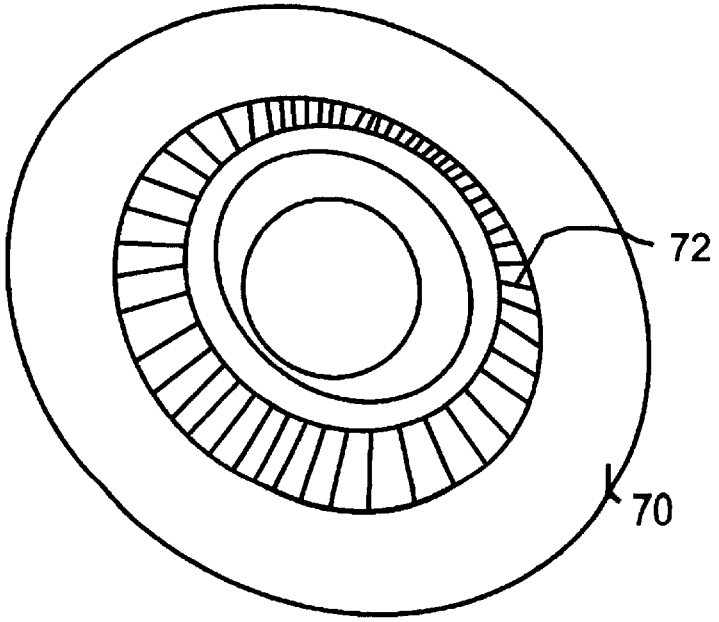
FIG. 5 is a perspective view of the bearing disc 70.
Figure 6:
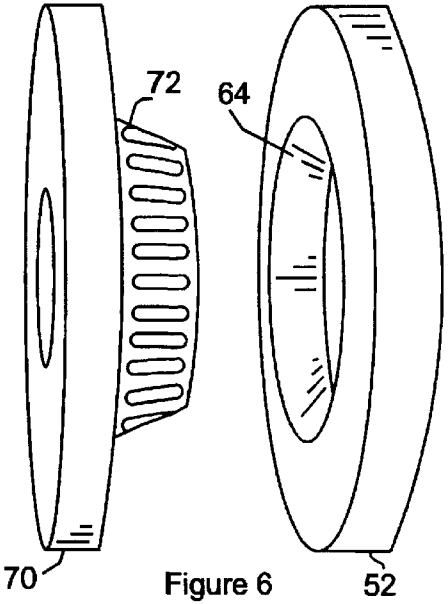
FIG. 6 is an exploded side view of the locking arc expansion assembly.

The bearing disc 70, illustrated in FIG. 5 contains the other half of the Timken type bearing 72. The disc 70 is provided with a raised lip 74 which is dimensioned to fit within the interior of the bearing 72. The shaft receiving area 76 is approximately equal to the shaft receiving area 58. The bearing 72 interacts with its counterpart, cylindrical bearing 64, as illustrated in FIG. 6.

Figure 7:
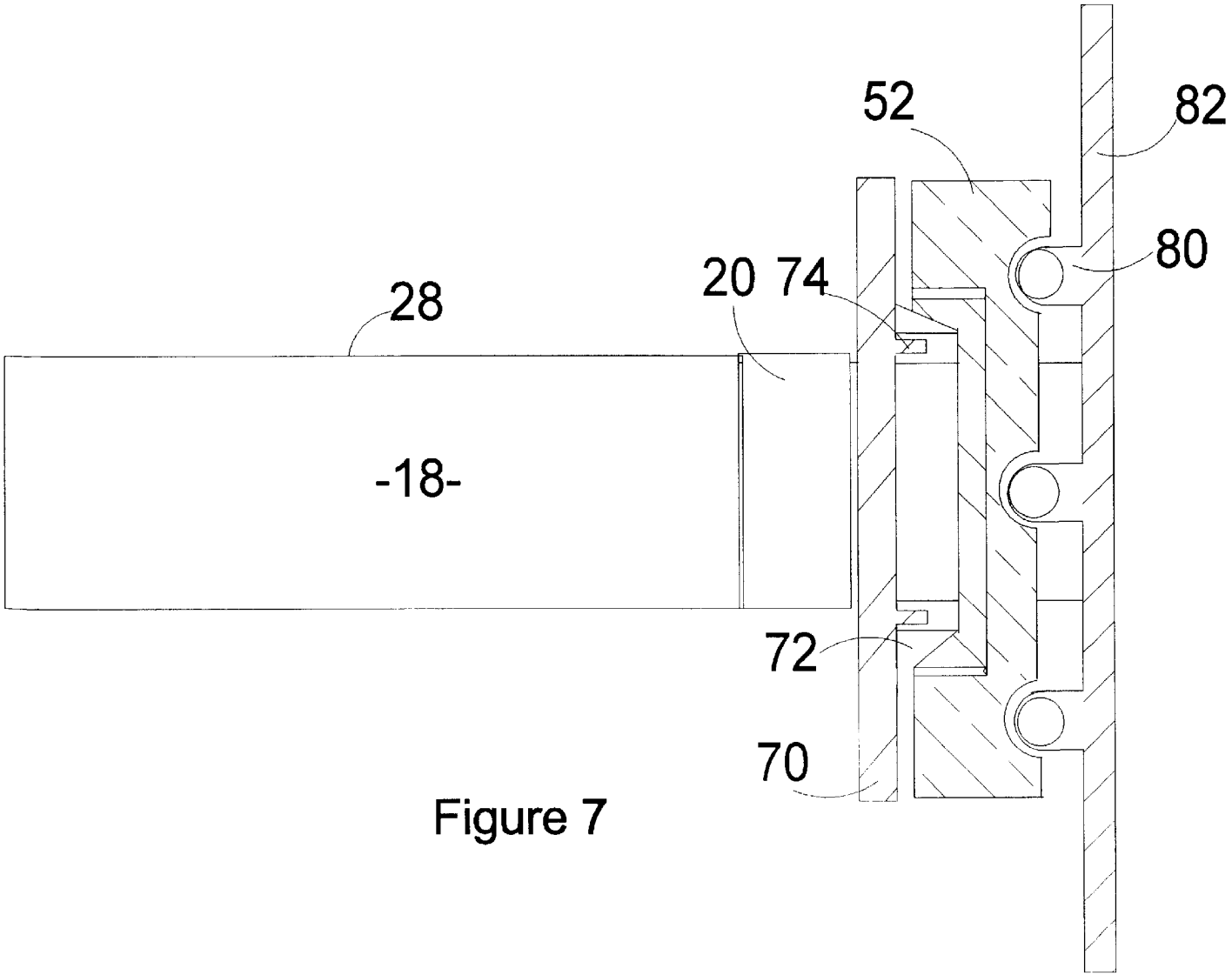
FIG. 7 is a side view of the retaining rod and locking arc in the unlocked position.
Figure 8:
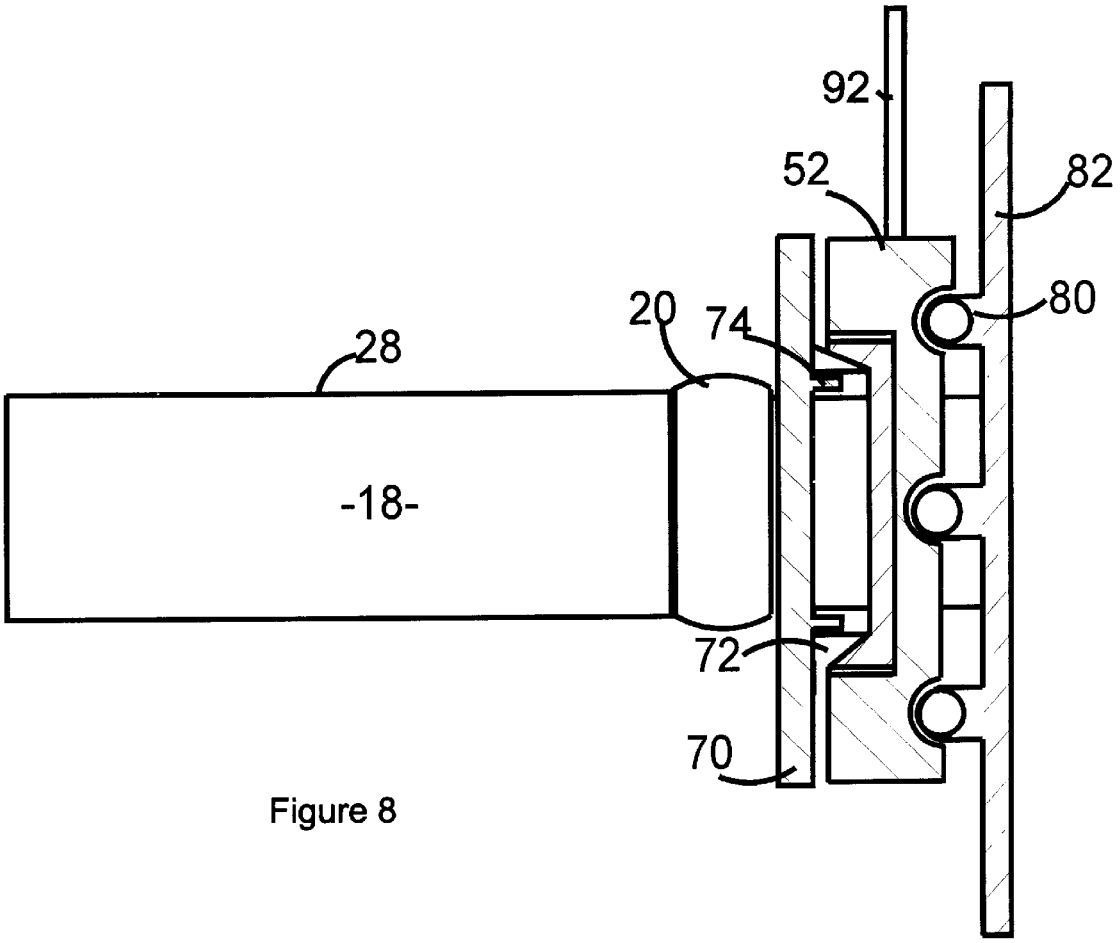
FIG. 8 is a perspective view of the retaining rod and locking arc in the unlocked position.

In FIGS. 7 and 8 the Timken bearing halves 52 and 70 have been assembled, forming locking arc 50, and the graduated gear 52 positioned onto the retaining wall 82. The bearing halves 52 and 70 are maintained in their horizontal position by the roller shaft 18 which is, in turn, maintained in position by being supported within the motor case 12. The roller shaft 18 is connected to the motor by means well known in the art. The locking arc assembly 50 is maintained in position along the shaft 18 through the pressure exerted by the cover 28 and the expansion ring 20.

In FIG. 7, the lever 92 (not shown in this figure) is in the unlocked position and the expansion ring 20 is flat, providing a smooth, even surface between the expansion ring 20 and the rigid cover 28. The rigid cover 28 is preferably manufactured from a resilient, slick material, such as flexible urethane, to allow the rolled material to easily slide on and off. The thickness of the rigid cover 28 must be sufficient to prevent buckling when pressure is applied to the expansion ring 20. Conversely, the expansion ring 20 must be manufactured from a material which will deform, or buckle, upon the application of pressure. A lighter weight material, such as urethane or rubber, will provide the desired buckling. In FIG. 8 the lever 92 has been rotated to the locked position and the spheres 80 have been situated in the sphere receiving areas 56. As the receiving areas 56 are not recessed to the same depth as the arcs 54, the placement of the spheres 80 into the sphere receiving areas 56 causes the locking assembly 50 to move in the direction of arrow A. As the expansion ring 20 is prevented from horizontal movement in the direction of arrow A by the stationary, rigid cover 28, the expansion ring 20 buckles.

As stated, when a roll of material 22 is initially placed on the rigid cover 28, the plane of both the rigid cover 28 and the expansion ring 20 are flush. As illustrated in FIG. 8, when the lever 92 is moved into the locked position, the expansion ring 20 is forced to bow, thereby applying pressure to the interior circumference of the core of the rolled material 22. The increased circumference of the expansion ring 20 locks the core of the rolled material 22 in position, preventing any side to side slippage during cutting. The radial expansion of the expansion ring 20 shortens the ring in width and the center of the arch which is formed moves toward the locking assembly 50. This coincides with the need to have the rolled material 22 firmly up against the bearing disc 70. The rolled material 22 is easily removed from the rigid cover 28 once the lever 92 is moved to the unlocked position.

The roller shaft 18 serves as a support for the rigid cover 28 and flexible expansion ring 20, as well as the rolled material to be cut. It is critical that the shaft 18 be at right angles to the cutting blade to provide a clean, right angle cut and that the shaft 18 is of sufficient thickness to support not only the weight of the rolled material but the pressure exerted by the saw blade to cut the material. Any wobble in the shaft 18 will affect the accuracy of the cut. Any number of materials which meet the criteria set forth can be used to manufacture the shaft 18, although steel currently provides the best cost/strength effectiveness.

It is critical that the bearing disc 70 does not shift in the direction of arrow A more than is required to slightly bow the expansion ring 20. By allowing too great a shift, and subsequently too much bowing, the expansion ring 20 can have a circumference great enough to damage lighter-weight material cores. The bowing must, however, be sufficient to hold the core in place. The amount of shift is not narrowly critical and will vary dependent upon the end use and size of the machine.

Figure 9:
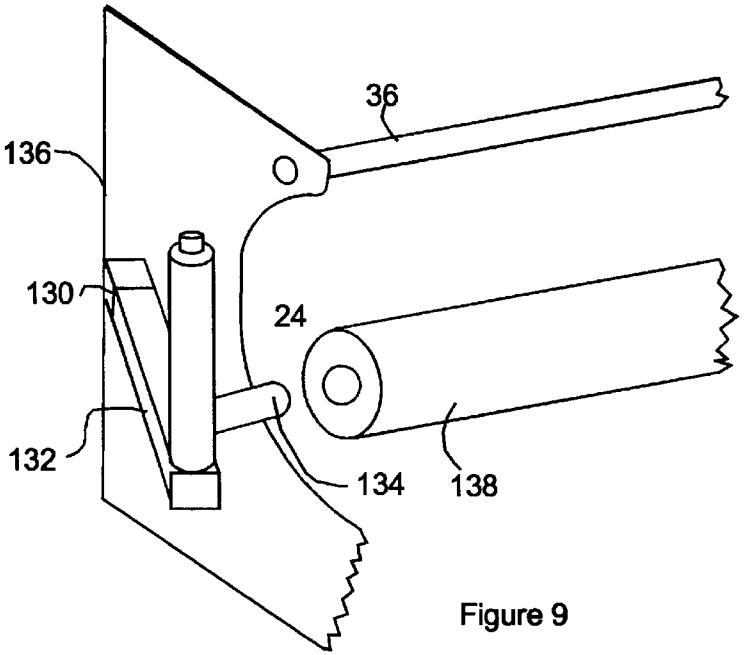
FIG. 9 is a perspective end view of the end shaft locking device in a partially open position.
Figure 10:
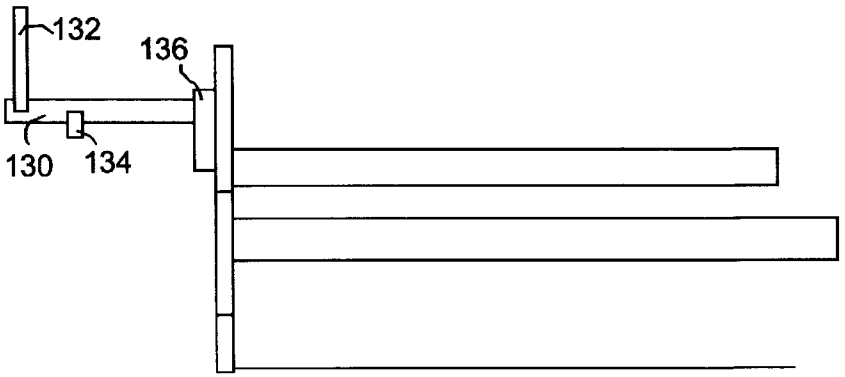
FIG. 10 is a perspective view of the end shaft locking device in an open position.

As seen in FIG. 1, the folded material 22 is placed upon the rigid cover 28 at the end opposite the expansion ring 20. To accomplish this one end of the shaft 18 must left accessible, placing all of the structural strength at the connection between the shaft 18 and the motor case 12. To provide support to the shaft 18 and prevent detrimental movement, the open end is supported through use of a locking mechanism. The locking mechanism, illustrated in more detail in FIGS. 9 and 10, consists of support bar 130, handle 132 and plug 134. The support bar 130 is connected to the contoured wall 14 through use of a hinge 136 which allows the support bar 130 to swing away from the contoured wall 14. A handle 132 is attached to the support 130 to allow for easy opening and closing of the bar 130. The plug 134 extends at right angles to the support bar 130 and is dimensioned to fit within the plug receiving area 138 within the shaft 18. Optionally, the plug receiving area 138 can be provided with a flexible, high friction coating, such as rubber, which is dimensioned to receive the plug 134 in a friction fit. The support bar 130 can also be maintained in position through use of various means, such as springs, friction hinges, etc.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A graduated gear assembly for providing controlled movement between a stationary support surface and exterior contact surface, said gear assembly having:

a first disc, said first disc having an exterior contact surface and an opposing bearing receiving surface, said bearing receiving surface having bearing retaining means, a second disc, said second disc having a first side and an opposing second side, said first side having a recessed bearing receiving area and said second side having a plurality of recessed arcs, a first end of each of said arcs containing a recessed sphere receiving area, a center support receiving area, said center support receiving area being proximate the center of said first disc and said second disc, a bearing, said bearing having a female portion and a male portion, said male portion dimensioned to interact with said bearing retaining means and said female portion being dimensioned to be received within said recessed bearing receiving area, a plurality of spheres, said spheres being immovably affixed to said support surface, said plurality of spheres being positioned to be received within said plurality of recessed arcs, handle means, said handle means being rigidly affixed to said second disc and moving in conjunction with said second disc, a roller shaft, said roller shaft being dimensioned to fit within said center support receiving area and being normal to said support surface, wherein said female portion of said bearing interacts with said male portion of said bearing to rotate said first disc and said second disc as a single disc unit, whereby said disc unit is rotated to a first position to place said spheres within said recessed arcs and a second position to place said spheres within said sphere receiving areas.

2. The gear assembly of claim 1 wherein rotating said disc unit to said second position moves said disc unit in a distal direction from said support surface.

3. The gear assembly of claim 2 wherein rotating said disc unit to said first position moves said disc unit in a proximal direction to said support surface.

4. The gear assembly of claim 1 wherein the movement of said disc unit between said first position and said position is determined by a ratio between said spheres and said recessed arcs and said sphere receiving areas.

5. The gear assembly of claim 1 wherein bearing retaining means is a lip proximate said center support receiving area.

6. The gear assembly of claim 1 further comprising a plurality of sphere receiving ridges, each of said sphere receiving ridges being proximate each of said recessed sphere receiving areas.

7. The gear assembly of claim 1 wherein said first disc and said second disc are a low friction material.

8. The gear assembly of claim 1 wherein said second disc recessed bearing receiving area further comprises a bearing ledge, said bearing ledge encompassing said center support receiving area and receiving said female portion of said bearing.

9. The gear assembly of claim 1 wherein said roller shaft rotates freely within said gear assembly.

* * * * *